US005979564A

United States Patent [19]

Crabtree

[11] Patent Number: 5,979,564

[45] **Date of Patent: *Nov. 9, 1999**

[54] FLUID ADDITIVE SUPPLY SYSTEM FOR FIRE FIGHTING MECHANISMS

[75] Inventor: Dennis W. Crabtree, Beaumont, Tex.

[73] Assignee: Willaims Fire & Hazard Control, Inc., Mauriceville, Tex.

[ * ] Notice: This patent is subject to a terminal disclaimer.

[21] Appl. No.: 08/842,231

[22] Filed: Apr. 23, 1997

Related U.S. Application Data

[62] Division of application No. 08/427,333, Apr. 24, 1995, Pat. No. 5,816,328.

[51] Int. Cl.[6] ..... A62C 5/02

[52] U.S. Cl. ..... 169/15

[58] Field of Search ..... 169/15

[56] References Cited

U.S. PATENT DOCUMENTS

| | | | |
|---|---|---|---|
| 4,436,487 | 3/1984 | Purvis et al. . | |
| 4,899,825 | 2/1990 | Bosoni et al. | 169/15 |
| 5,009,244 | 4/1991 | Grindley et al. | 169/15 |
| 5,174,383 | 12/1992 | Haugen et al. | 169/15 |

*Primary Examiner*—Gary C. Hoge
*Attorney, Agent, or Firm*—Sue Z. Shaper; Butler & Binion, LLP

[57] ABSTRACT

An additive supply mechanism and method for fire fighting mechanisms, such as fire fighting trucks, including an additive supply conduit, an additive pump means, a recirculation line having a balanced pressure valve throttling the line, at least one sensor measuring recirculation line flow and an additive pump output control apparatus responsive to measured recirculation line flow.

11 Claims, 3 Drawing Sheets

TO MONITOR
80
77
78
76
P
96
96
92
82
24
52
68
66
60
62
64
70
70
74
M
72
P
84
98
88
86
40
50
100
22
M
34
34
34
32
30
30
30
30
30
30
26
26
20
44
42
46
46
46
46
46

FLUID ADDITIVE SUPPLY SYSTEM FOR FIRE FIGHTING MECHANISMS

This application is a continuation-in-part of pending patent application U.S. Ser. No. 08/427,333 filed Apr. 24, 1995, now U.S. Pat. No. 5,816,328.

FIELD OF INVENTION

This invention relates to fluid additive supply systems for fire fighting mechanisms, and in particular, to an improved system for adding foam concentrate into water lines on a fire fighting truck.

Fire fighting mechanisms, such as fire fighting trucks, typically include a source of water as the primary fire fighting fluid. The source is connected to a water pump that supplies a plurality of nozzles or discharge outlets with water within a designed pressure range. Each nozzle or outlet usually contains a valve for placing the nozzle or outlet in or out of service. The truck may be connected to a hydrant supplying water at significant pressure. In this case the water pump heightens the pressure. The number of nozzles in use and the source of water can cause water pressure at the nozzle outlets to vary significantly.

Usually there is provided for each nozzle or outlet an inlet port and a valving mechanism for the intake of an additive, such as a foam concentrate solution. The intake port for the additive typically contains a valve for turning on or off the additive supply system and, if "on", for selecting the appropriate amount of additive to "meter" into the water line. For example, foam concentrate might be "metered" into a water line at either 3% or 6%.

To add the correct amount of additive into a particular fire fighting fluid line, such as at a nozzle, the system should supply additive at approximately the same pressure as the pressure of the fire fighting fluid.

Various systems exist to supply additive at what is referred to as a "balanced pressure," taking into account that the pressure of the firefighting fluid, or water, can vary significantly and frequently due to a variety of factors, some mentioned above, such as the number of nozzles in service, the speed of the water pump and the pressure of the water source. Furthermore, the pressure of the additive is a function of the speed of the additive pump and the demand for additive, which can vary from demand at all nozzles to demand at only a few nozzles or at no nozzles. Additive and water pump speeds generally both track the truck engine speed, although one or both might have a manual override. The additive pump may also have an additional speed controller. Further, pressure in the additive manifold may be affected by a recirculation line.

One system used to supply "balanced pressure" additive has been to place the additive in a bladder that is placed inside a container filled with water at the pressure of the water in the fluid line. This system insures that the additive is supplied from the bladder at the same pressure as the current water pressure. However, such system has drawbacks. It is cumbersome and difficult to deal with when more additive is required than can be contained in one bladder, which is ever more frequently the case.

Other "balanced pressure" systems that have been developed involve an additive pump. These pump systems have been of two basic types. One type, a bypass system, utilizes a balanced pressure valve located in a recirculation line connected around the pump in an additive supply conduit powered by said pump. The "balanced pressure" valve controls effective additive discharge pressure by varying an amount of additive bypassed, or recirculated back, behind the pump. Such bypass systems have proven accurate in balancing pressure. They can have efficient operating limits, however.

Another additive pump type system utilizes a pump with a controllable output. One such hydraulically powered "demand" system directly controls additive pump output to "balance pressure" by using a servo mechanism as a controller, responsive to sensed water pressure and to sensed additive pressure.

A "direct injection" proportioning system as a version of a "demand" system has also been developed, varying the output of an additive pump to inject additive directly into a water pump discharge line, in response to electric signals. A meter installed in the water pump discharge line measures water flow rate. This flow meter signal is processed by a microprocessor to match the output of the flow on the additive pump with a measure of the additive pump output fed back to the microprocessor to maintain the additive flow rate at the proper proportion to the water flow rate.

Although more complex in design, "demand" balanced pressure proportioning systems that directly control the output of the additive pump have an advantage in that their operating range usually places no restriction on water inlet pressure. Their accuracy and reliability, however, generally do not compare with that of a traditional "bypass" or recirculating system, or even a traditional "bladder" system.

The instant invention retains the favorable attributes of the traditional "bypass" system while addressing the problems of such system's limitations by adjustments to the additive pump output. The invention could incorporate, in alternate embodiments, electric controls such as found in direct injection proportioning devices, as would be understood by one of ordinary skill in the art. It should also be understood that manual backup modes would almost always be provided in commercial systems, although such may not be fully discussed below.

More particularly, the present invention utilizes the benefits of the reliability and accuracy of a balanced pressure valve operating on a recirculation line. At the same time the invention enhances and optomizes the efficiencies of the "bypass" system and provides a mode to minimize wear and tear on the additive pump system. The invention is especially effective with newer "thixotropic" additives. The invention operates by providing a means to adjust the output of the additive pump in response to sensed limits in recirculation line flow rate. The capacity to additionally adjust the additive pump output helps insure that the balanced pressure valve is operating optimally and efficiently above a low flow limit for performance that minimizes the possibility of hysteresis and below a high flow limit to prevent excessive recirculation. It is believed that general problems of hunting or hysteresis, which have been encountered historically in both diaphragm valve recirculation line systems and demand systems, are minimized as well with the instant invention.

The invention utilizes a still further benefit of recirculation lines. Modern fluid additives frequently comprise "thixotropic" foam concentrates. Thixotropic foams have a relatively high viscosity, i.e. gel-like, when left relatively stationary but a liquid-like viscosity when sufficiently agitated. A recirculation line permits a portion of the additive to be continuously circulated, thereby tending to maintain the additive supply line in an agitated state having a desired liquid-like viscosity, even during periods of low demand and/or low pressure. The additive system is thus ready for quick response when needed.

Both high flow rate and a low flow rate sensors are preferably used in the recirculation line in the present invention, to sense rate of flow of additive. In accordance with preset limits, the sensors signal a "step up" or "step down" of additive pump output. Such control permits the balanced pressure valve in the recirculation line to operate with optimized efficiency and provides an automatic mode to minimize wear and tear on the additive pump during start up. A manual backup system may also be provided in case, for instance, battery operated electric control systems or the like malfunction or fail. The manual system would permit a manual stepping up or down the output of the additive pump in accordance with a visual display showing fire fighting fluid pressure and additive pressure.

SUMMARY OF THE INVENTION

The present invention comprises an improved additive supply system for a fire fighting mechanism. A fire fighting truck illustrates such a mechanism. The invention includes an additive supply conduit connecting an additive source with a fire fighting fluid line. The fire fighting fluid is usually water and may be assumed to be so in the discussion below. The conduit is in fluid communication with an additive pump means and a recirculating line. The additive pump means typically comprises a separate additive pump, but any means for variably pumping additive could function equivalently.

A balanced pressure valve throttles a recirculating line, the valve being in communication with a measure of additive pressure and a measure of fire fighting fluid pressure. Flow through an orifice is increased or decreased in the recirculation line to adjust the pressure of the additive, sensed at a position upstream of the orifice, to balance additive pressure with the water pressure.

An additive pump control mechanism is also provided, capable of varying or adjusting additive pump output. The mechanism is in communication with at least one recirculation line flow sensor and is responsive to the sensor. The recirculation line flow sensor(s) and additive pump control mechanism form a means for controlling additive pump output in response to sensed recirculation line flow.

The invention includes a method for supplying additive to a fire fighting mechanism, such as a fire fighting truck, at a pressure "balanced" to the pressure of a fire fighting fluid, such as water. The method includes pumping additive from a source to a fire fighting fluid line while recirculating back a portion of the additive to balance additive pressure to water pressure. The method further includes varying additive pump output in response to sensed recirculating line flow limits.

In preferred embodiments the fluid additive is a foam concentrate, possibly a thixotropic material. The fire fighting fluid is usually water. The flow rate sensors preferably include a high flow sensor and a low flow sensor, although having just one or the other sensor would possibly be better than having none at all.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENTS

Figure 1:
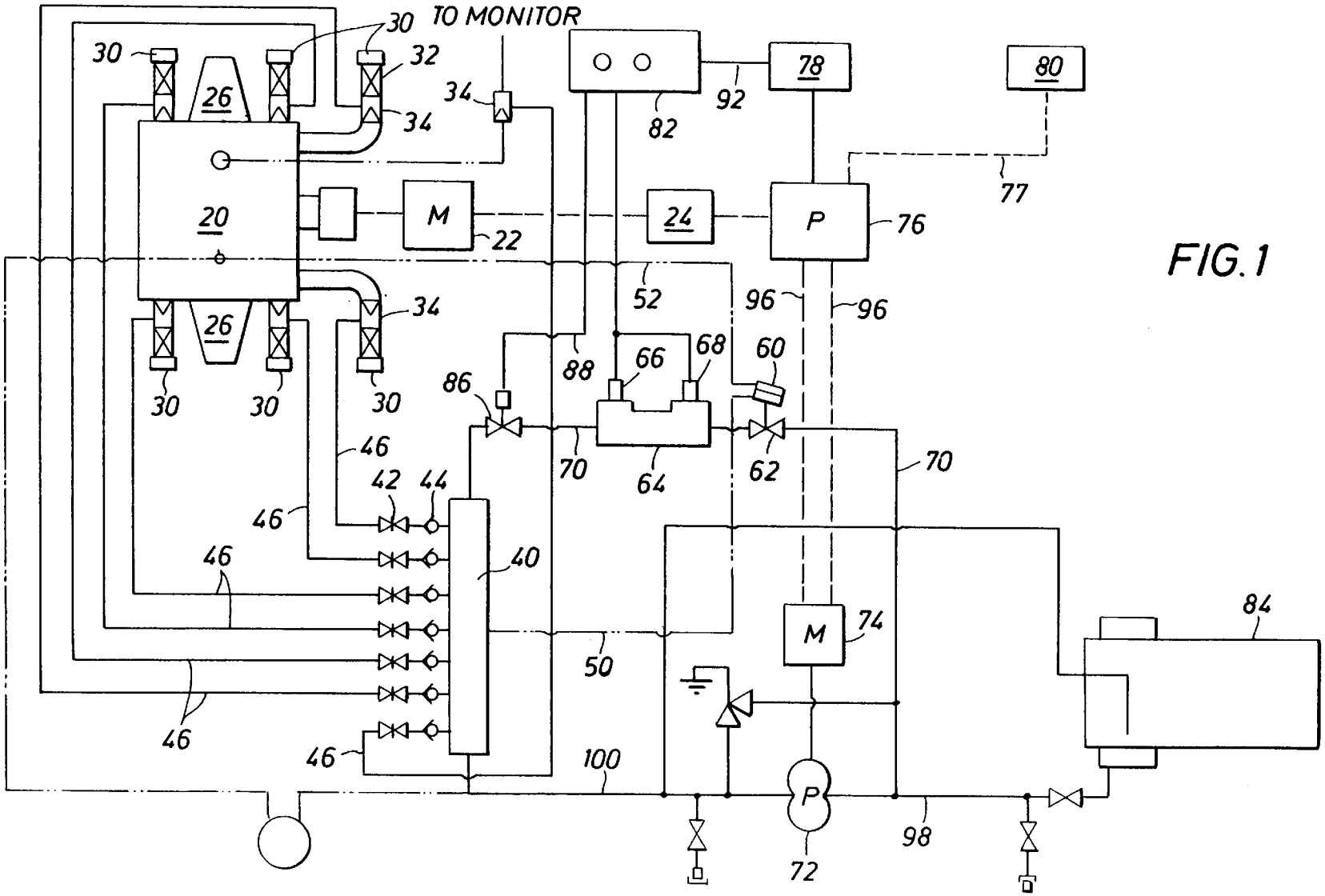
FIG. 1 offers an illustrative view of components of an additive and water supply system for a fire fighting truck, in a stylized form familiar to the industry, together with an illustration of how such system can be adapted to include the system of the present invention.

FIG. 1 illustrates schematically one preferred embodiment for the present invention. The Figure shows an additive supply system adapted for a fire fighting truck. Additive, such as foam concentrate, is shown stored in concentrate tank 84. The fire fighting fluid of the embodiment of FIG. 1 will be referred to for convenience as water, although use of any fire fighting fluid is appropriate. Water is shown as drawn from any convenient source, through input orifices 26, and shown as pumped by water pump 20, illustrated as driven by motor 22. Water flows through supply lines to discharge outlets or nozzles 30. The water could be fresh, brackish or sea water. An array of discharge ports 30 is illustrated, including a monitor nozzle.

The foam concentrate, comprising the additive in this example, could be a thixotropic foam concentrate containing polysaccharides or heteropolysaccharides. These are sometimes preferred in the fire fighting art for use in the extinguishment of hydrophilic flammable liquids such as acetone, isopropanol, ethanol, methanol or tetrahydrofuran. The fire fighting system of the embodiment of FIG. 1 is particularly adapted for extinguishing flammable liquid fires and for suppressing flammable, toxic or other hazardous vapors or gases.

Discharge ports 30 of the system of the embodiment are shown having shut-off valves 32 and ratio flow controllers 34, as is known in the art. Valves 32 open and close discharge ports 30. Ratio flow controllers 34 enable the proper admission of the additive into the discharge port conduits via discharge conduits 46 of the additive supply system. Ratio flow controllers 34 are typically of a modified venturi design to create a lowered pressure zone in the discharge conduit, thereby assisting even thixotropic fluids to be admitted at flow rates directly proportional to the flow rate of the water being pumped through the conduit when valve 32 is open.

Additive supply line discharge conduits 46 lead upstream from ratio flow controllers 34 to the ports of additive manifold 40 in the additive supply system. Check valves 44 on supply lines 46 prevent reverse flow of additive. Typically, additive supply line discharge conduits 46 contain metering valves 42. Metering valves 42 operate to either isolate ratio flow controllers 34 from the additive pump or, when open, to meter flows through lines 46.

Manifold 40 in the additive supply system is connected to additive pump 72 by conduit 100. Additive pump 72 is connected upstream, by conduit 98, to additive concentrate tank 84.

In the preferred embodiment, additive pump 72 is illustrated as powered by a typical hydraulic drive and control mechanism which a comprises a hydraulic motor 74 and a variable output hydraulic pump 76. Hydraulic motor 74 may be of any known design, such as the "Eaton Hydrostatic Motor Model 33 through Model 54" manufactured by the Eaton Corporation Hydraulics Division of Eden Prairie, Minn. Hydraulic motor 74 may be mechanically coupled to additive pump 72 and placed in hydraulic fluid communication, via feed and return lines 96, with a variable displacement hydraulic pump 76, as is known in the art.

Hydraulic pump 76 may also be of a commonly known design, as for example the "Eaton Corporation Pump Model 33 through model 54" manufactured by the Eaton Corporation Hydraulics Division of Eden Prairie, Minn. Both the hydraulic pump and hydraulic motor are of a design known to those in the art of hydrostatic drives. The hydraulic pump can include an internal rotary gear charge pump and can be driven, for instance, via an input shaft of power take-off (PTO) 24 of motor or engine 22, or by any other power source. The system would be adjusted to prevent reverse rotation of the additive pump.

Hydraulic pump 76 would be connected by suction line 77 to a hydraulic fluid reservoir tank 80. The speed of rotation of hydraulic motor 74 varies directly with the output of hydraulic pump 76, thereby varying the output of additive pump 72.

When system control panel 82 is in an off position, power take-off 24 would be discharged and no additive would flow. Hydraulic pump control 78 may also receive a signal through electrical conduit 92 to move control cables to a lowest speed setting, preferably zero, of hydraulic pump 76 in preparation for next use. Initiating additive pump 72 at a low speed tends to minimize wear and tear on the pump from a mechanical standpoint. A low flow sensor in the recirculating line, provided by the instant invention, insures that the pump speed is gradually stepped up into an efficient operating range.

When system control panel 82 is set for automatic operation, the PTO is engaged and the hydraulic pump operates at the speed determined in part by the setting of hydraulic pump control 78. In general, changes in the speed of the truck engine, translated through the PTO, affect hydraulic pump 76 and water pump 20 similarly. However, the speed of rotation of the hydraulic drive, and hence the output of additive pump 72, is also affected by the setting of hydraulic pump control 78 in the instant invention. The setting of hydraulic pump control 78 can be affected, in turn, by flow switches 66 and 68 of flow switch manifold 64, attached in recirculation line 70, as discussed more fully below. The hydraulic pump control may also have a manual override.

When control panel 82 is first placed in the automatic position, a control signal is sent via electrical conduit 88 to a powered shut-off valve 86, causing it to open and permit recirculation flow through recirculation line 70, balanced pressure valve 62 and flow switch manifold 64. The PTO engages hydraulic pump 76 causing additive pump 72 to operate at a setting partially determined by hydraulic pump control 78. While the flow in recirculation line 70 is above a low flow rate, as measured by low-flow switch 68 and below a hi-flow rate, as measured by hi-flow switch 66, pump control 78 is not activated. However, if the flow in recirculation line 70 falls below a low flow rate limit, say 5 gpm, or above a hi-flow rate limit, say 20 gpm, switches 68 and 66, respectively, signal, through control panel 82, for pump control 78 to step up or down, respectively, the speed of additive pump 72 for an increment of time, say ½ second. After a period of delay time, say 1 second, pump control 78 can again step up or step down the output of additive pump 72, if so signaled.

Figure 2:
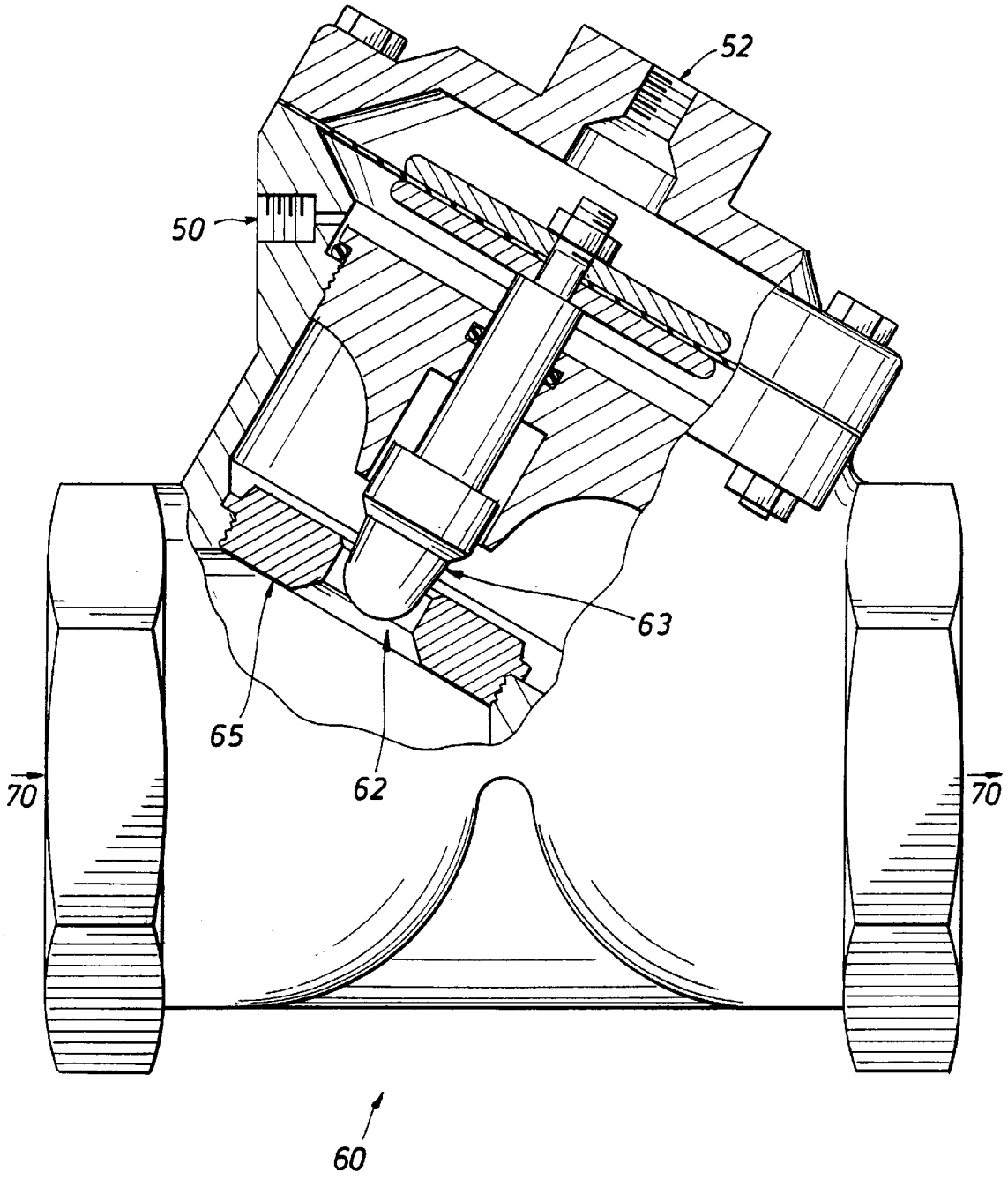
FIG. 2 illustrates, partially in cutaway, a pressure balancing valve flow control device throttling a recirculation line.

As more clearly illustrated in FIG. 2, balanced pressure diaphragm valve 60 is sensitive, through conduit 52, to a measure of water pressure generated by water pump 20 and, through conduit 50, to a measure of additive pressure generated in concentrate manifold 40. When water pressure is greater than additive pressure, piston 63 of balanced pressure valve 60 tends to move toward seat 65. This movement meters down and inhibits additive flow through orifice 62 of the balanced pressure valve. Back pressure increases in the concentrate additive manifold 40 to the point where it balances the sensed water pressure in pump 20.

Given the sensed water pressure currently generated by water pump 20, and the sensed additive pressure generated in manifold 40 at the existing speed of additive pump 72, and as affected by the back pressure created by piston 63, balanced pressure valve 60 settles upon an equilibrium position wherein piston 63 throttles orifice 62 to a certain degree. If the recirculation line flow satisfies standards of efficient flow, or flow rate, say between a low acceptable rate of 5 gpm and a high acceptable rate of 20 gpm, pressure is not only balanced but the balanced pressure valve 60 is satisfying standards of efficient flow within the recirculation line. In this circumstance, the speed of additive pump 72 does not change. No control signal is sent via line 92 to step up or step down the drive mechanism of pump 72.

If, however, piston 63 settles on a balanced pressure position that results in too great or too little flow in recirculation line 70, as determined by sensors 66 and 68, to satisfy efficiency concerns pump controller 78 will be activated.

In the preferred embodiment, low-flow switch 68 and hi-flow switch 66 close circuits. The circuits include a battery source, such as a DC 12 volt battery, or such as the truck battery. The circuits run through control panel 82 and include a timer. The timer allows the circuits to engage pump controller 78 to step up or step down the speed of concentrate pump 72 for only a short period, say ½ second. Then, for a delay period of time, say one second, pump controller 78 is not allowed to affect the speed of concentrate pump 72. This time period allows diaphragm valve 60 to balance pressure at another position of piston 63.

Figure 3:
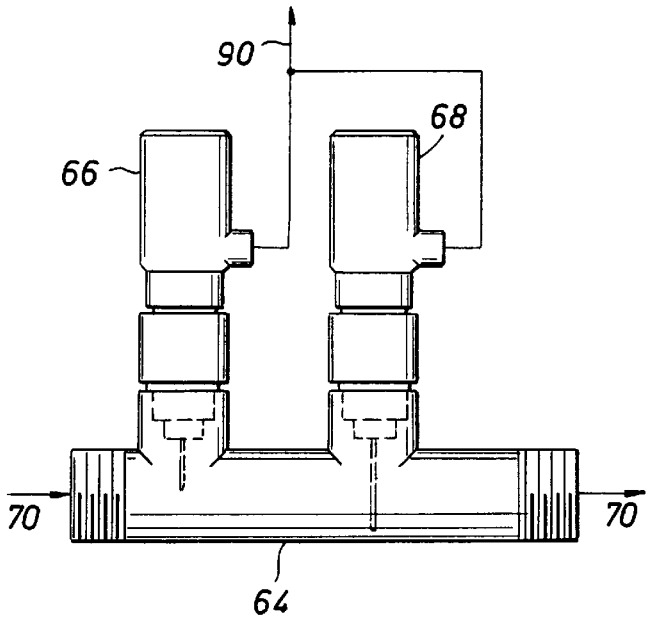
FIG. 3 illustrates a flow control manifold containing a lo-flow and a hi-flow sensor.

FIG. 3 illustrates in greater detail flow switch manifold 64. Manifold 64 operates upon recirculation line 70. High flow switch 66 and low flow switch 68 may be purchased switches. Flotect model V4-2-U, "Vane Operated Flow Switch", performs satisfactorily. Flow limits can be set on each switch. When flow exceeds a set limit, a "normally open" high flow switch 66 closes a circuit. When flow recedes below a set limit of low flow switch 68, the switch (which may be "normally" closed but will have been opened by prior flow that was over the low flow limit) again closes a circuit. Line 90 carries the flow switch circuit lines to the actuator control 78 for hydraulic pump 76, via control panel 82, as more particularly illustrated in FIG. 4.

Figure 4:
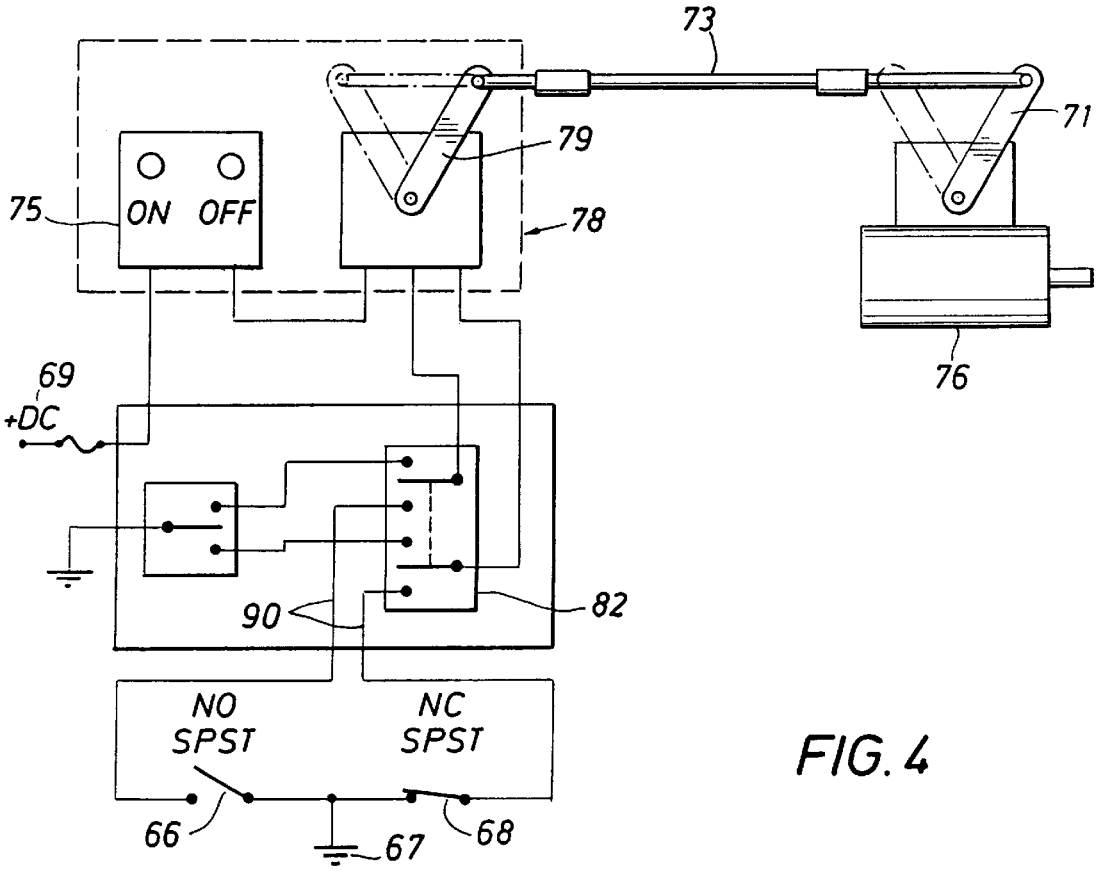
FIG. 4 illustrates schematically portions of a hydraulic pump control system for periodically adjusting additive pump output in response to flow sensors.

Referring to FIG. 4, FIG. 4 indicates in greater detail how low flow switch 68 and high flow switch 66 can close and open circuits. Power is provided to the circuit by a DC input 69 such as a 12-volt battery or such as the fire truck battery. The electrical circuit includes timer 75. Timer 75 provides for an on-time and an off-time period. In the preferred embodiment a ½ second on-time and 1 second off-time is selected. Control panel 82 switch can set the system on off, manual or automatic. Assuming that the control panel 82 switches are set on automatic, and high flow switch 66 has been closed, a circuit is closed from the DC power source to ground, the circuit including actuator 78, which permits power to be pulsed through timer 75 during its on-time, to move actuator arm 79 in a first direction. Actuator arm 79 through cable 73 moves actuator arm 71 on hydraulic pump 76 in a first direction. Such movement of lever 71 controls the output of hydraulic pump 76 as, for instance, by varying the angle of attack of vanes within hydraulic pump 76. Methods to control or vary the output of hydraulic pump 76 are known to those skilled in the art.

When control panel 82 switches are in automatic mode and low flow switch 68 is closed, a second path is created from DC source 69 through timer 75 and actuator 78 to ground 67. In this case, current flows through a second line in actuator 78, moving actuator arm 79 in a second direction. Actuator arm 71, connected to hydraulic pump 76, follows via cable 73 the movement of arm 79 of actuator 78.

In operation, pressure balancing diaphragm valve 60, by throttling orifice 62, will increase or decrease additive flow in recirculation line 70 such that additive pressure, as sensed in additive manifold 40 for instance, balances water pressure, as sensed in water pump 20 for instance. If high flow or low flow switches in recirculation line flow monitor 64 detect a recirculation line flow rate that is sufficiently low that it might impede efficiency, such as by enhancing the possibility of hysteresis, or so high that the system is inefficient because it recirculates excessive additive fluid, then additive pump regulator 78 will vary the output of hydraulic pump 76. Varying the output of hydraulic pump 76 affects the speed at which hydraulic drive 74 powers additive pump 72. A timer associated with actuator 78 permits the additive pump speed to be stepped up or stepped down for a period of time, followed by delay period of no change in speed. During the delay period, pressure balancing valve 60 has an opportunity to balance pressure at a different recirculation line flow which may no longer trigger either the high flow or low flow sensor.

It can be noted that the recirculation line is structured in coordination with the demand for additive and additive pump speeds such that inefficiently low flow in the recirculation line is not likely. Variations in the water pump speed and the additive pump speed usually move in lock step due to both being a function of the engine speed of the truck. One reason for "low flow" to occur is in consequence to a prior stepping down of the additive pump speed in response to a "high flow" or excessive flow signal. It could also happen that water pump 20 is operating off of a pressurized source of water, such as from a hydrant. In such case, the water pressure generated by pump 20 might be unusually high. In order to balance pressure valve in the additive manifold, the balanced pressure valve may need to throttle the recirculating line to approach a closed state. Such may create low flow. The pressure balancing valve may not operate efficiently and reliably under conditions of low flow, or at least the valve's potential for efficient and reliable operation may be diminished. For instance, under such low flow conditions the balanced pressure valve might have a tendency to hunt for, as opposed to settle on, the balanced pressure state. Thus, at some point with the present invention, a sufficiently low flow will trigger the low flow sensing valve.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. An additive supply system for fire fighting mechanisms, comprising:

an additive supply conduit connecting an additive source with a fire fighting fluid line, the conduit being in fluid communication with an additive pump means and a recirculating line;

a balanced pressure valve throttling the recirculating line, the valve being in communication with a measure of additive pressure and a measure of fire fighting fluid pressure;

at least one recirculation line flow sensor; and an additive pump control mechanism capable of varying additive pump output, the mechanism being in communication with a recirculating line flow sensor.

2. An additive supply system for fire fighting mechanisms, comprising:

an additive supply conduit connecting an additive source with a fire fighting fluid line, the conduit being in fluid communication with a pump means and a recirculating line;

a balanced pressure valve throttling the recirculating line, the valve being in communication with a measure of additive pressure and a measure of fire fighting fluid pressure; and means for controlling additive pump output in response to a measure of recirculating line flow.

3. A method for supplying additive to a fire fighting mechanism at a pressure balanced to a fire fighting fluid pressure, comprising:

pumping additive from a source to a fire fighting fluid line;

recirculating a portion of the additive pumped around the pump to balance pressure between a portion of the additive line and a portion of the fire fighting line; and varying the additive pump output in response to recirculation line flow rate.

4. The apparatus of claim 1 or 2 wherein the fluid additive comprises foam concentrate.

5. The apparatus of claim 1 or 2 wherein the fluid additive comprises a thixotropic material.

6. The apparatus of claim 1 or 2 wherein the fire fighting mechanism comprises a fire fighting truck.

7. The apparatus of claim 1 or 2 that includes a low flow recirculation line sensor and a high flow recirculation line sensor.

8. The method of claim 3 that includes varying pump output in response to a low flow rate signal and a high flow rate signal.

9. The method of claim 3 wherein pumping additive comprises pumping foam concentrate.

10. The method of claim 3 wherein pumping additive comprises pumping a thixotropic material.

11. The method of claim 3 wherein supplying to a fire fighting mechanism comprises supplying to a fire fighting truck.

* * * * *

UNITED STATES PATENT AND TRADEMARK OFFICE

CERTIFICATE OF CORRECTION

PATENT NO. : 5,979,564

DATED : November 9, 1999

INVENTOR(S) : Dennis W. Crabtree

It is certified that error appears in the above-identified patent and that said Letters Patent is hereby corrected as shown below:

ON THE TITLE PAGE:

entry field [62], delete "Division" and insert --A continuation-in-part--.

entry field [73], delete "Willaims" and insert --Williams--.

Signed and Sealed this

Eleventh Day of July, 2000

*Attest:*

Q. TODD DICKINSON

*Attesting Officer*

*Director of Patents and Trademarks*